United States Patent [19]

Marshall

[11] 4,056,069

[45] Nov. 1, 1977

[54] METHOD OF BURNING REFUSE

[75] Inventor: John Edward Marshall, Aldridge, England

[73] Assignee: Imperial Metal Industries (Kynoch) Limited, England

[21] Appl. No.: 669,497

[22] Filed: Mar. 23, 1976

[30] Foreign Application Priority Data

Apr. 7, 1975 United Kingdom ..... 14144/75

[51] Int. Cl.[2] ..... F23G 5/08; F23B 1/22

[52] U.S. Cl. ..... 110/7 R; 110/10; 110/40 R

[58] Field of Search ..... 122/2; 110/7 R, 8 R, 110/10, 15, 40

[56] References Cited

U.S. PATENT DOCUMENTS

| | | | |
|---|---|---|---|
| 2,032,412 | 3/1936 | Greenawalt | 110/15 |
| 2,045,115 | 6/1936 | Allen et al. | 110/15 |
| 2,386,336 | 10/1945 | Mosshart | 110/40 |
| 2,925,055 | 2/1960 | Miller et al. | 110/7 |
| 3,064,593 | 11/1962 | Burk et al. | 110/8 |
| 3,489,110 | 1/1970 | Miller | 122/2 |

*Primary Examiner*—Kenneth W. Sprague
*Attorney, Agent, or Firm*—Cushman, Darby & Cushman

[57] ABSTRACT

A method of burning refuse to obtain heat which comprises injecting refuse through the back wall of a coal-fired moving grate furnace so that the refuse is burnt either in flight or falls onto the moving bed of coal and is burned with the coal.

14 Claims, 2 Drawing Figures

METHOD OF BURNING REFUSE

BACKGROUND OF THE INVENTION

This invention relates to methods of burning refuse or garbage and has particular reference to boilers for burning refuse as part of the fuel.

The steady increase in the volume of urban waste is causing increasing problems associated with its disposal. Waste is becoming steadily less dense which means that the volume is increasing disproportionately with the weight of the material. The calorific value of refuse has steadily increased through the past 30 years because the amount of paper and plastics material in refuse has increased while the ash content has decreased.

As the number of suitable dumping sites reduces, particularly in or near large urban areas, there has been an increase in the amount of refuse which is burnt in refuse incinerators to reduce the volume to more manageable levels. A certain amount of heat has been recovered from these incinerators but the reduction in volume has hitherto been more important than the heat recovery. To date, there have been very few successful installations which use refuse as a significant source of energy.

An investigation of the literature and prior patent specifications has revealed two British Pat. Nos. 366,307 and 436,708, which were published in 1932 and 1935 respectively. It is not known whether the inventions described in these patent specifications were ever used in practice but it can be seen that the invention described in both of the specifications would have been difficult to use in practice. Both involved extensive modifications to existing furnaces and both involved the addition of large quantities of rubbish to an existing bed of coal. In both cases, the rubbish was added from the front end of the furnaces, ie from the front wall, and this means that it was not possible to obtain suspension firing of the rubbish. This would result in a thick layer of rubbish being applied to the bed of coal and the advantages of the present invention would not have been obtained. Even if the rubbish were to have been injected rapidly from the front wall, it would have fallen to the back of the furnace onto the bed of coal and would not have burned efficiently before passing to the ash disposal unit.

In British Pat. No. 366,307, the moving bed of coal is agitated by reciprocating fire bars to agitate the coal bed and to intermix the refuse and coal. This would be a difficult system to install and could result in large areas of refuse in the coal being burnt through and offering an easy escape route for air in the air chamber beneath the fire grate.

With the arrangement described in British Pat. No. 436,708, a very thick layer of refuse is applied to a relatively thin layer of coal, again at the front of the chain grate and it is known that these thick beds of refuse burn incompletely and are unsatisfactory from the point of view of generating steam.

SUMMARY OF THE INVENTION

By the present invention, there is provided a method of burning refuse including the steps of establishing a substantially uniform bed of burning coal on a moving grate floor, the bed of burning coal being located at the lower end of a combustion chamber, and injecting refuse in particulate form through the back wall of the combustion chamber in the opposite direction to the direction of movement of the grate.

The refuse may be injected by being entrained in an air jet directed into the combustion chamber; the air jet may be directed parallel to the grate.

There may be a classifying air jet directed up at the moving stream of refuse inside the combustion chamber. The classifying air jet may be provided at substantially the same pressure as the air jet which entrains the refuse. The grate may be a moving chain grate.

The bed of coal is preferably thoroughly alight and burning before the bed is moved into an area in which the refuse can land on the bed and further may be thoroughly alight and burning within an arch in the furnace over the inlet end of the grate.

The refuse may have a particle size distribution such that 80% of the refuse has an average diameter of less than 5 cm and the refuse may be treated to remove the magnetic particles.

There may be a 50% excess of air supplied to the combustion chamber compared to that theoretically required to oxidise the coal and refuse. The refuse may supply 25–75% of the total heat input to the combustion chamber. The air jet which entrains the refuse may supply 10% of the total volume of air to the combustion chamber and the secondary classifying air jet may supply a further 10%.

BRIEF DESCRIPTION OF THE DRAWINGS

By way of example, an embodiment of the present invention will now be described with reference to the accompanying drawings, of which.

DESCRIPTION OF THE PREFERRED EMBODIMENT

Figure 1:
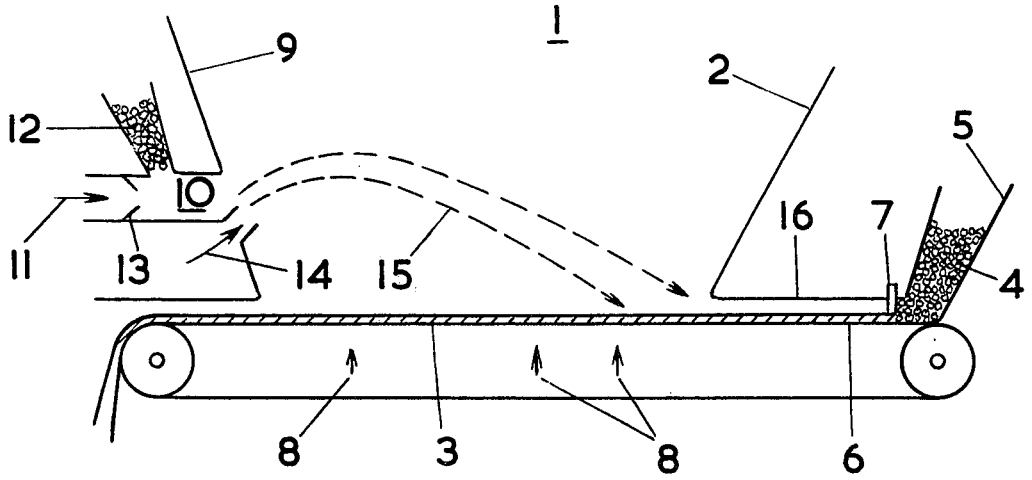
FIG. 1 is a schematic cross-section of a moving grate furnace.

The furnace comprises a conventional combustion chamber but having water tube-lined walls 2 and a moving chain grate 3 at the bottom. Coal 4 is supplied from a hopper 5 at the front end of the grate and is distributed uniformly over the width of the grate to give a controlled thickness 6 in the region of 8 to 12 inches. The thickness is controlled by means of a suitable gate 7 which may be raised or lowered as required. Air is passed through the grate 3 in the direction of the arrows 8 to burn the coal in the conventional manner.

The back wall 9 of the combustion chamber 1 has an aperture or apertures 10 into which is fitted an injector 13. High velocity air 11 is admitted through the injector. Particles of shredded domestic refuse fall into the air stream at the injector and are propelled into the combustion chamber. The heavier particles are projected along the dotted lines 15 and fall onto the moving bed of coal and are burnt with the coal. As the air-burnt shredded refuse enters the combustion chamber, a high velocity air stream 14 which is directed up underneath the stream of refuse deflects and carries the lighter fraction of the refuse into the upper area of the combustion chamber where it burns in suspension. The air stream 14 also deflects the heavier particles so that they spread across the full breadth of the grate. The presence of the continuous bed of coal means that a proper flame is established within the combustion chamber and the heavier particles of refuse land on the moving bed and are burnt with it.

It has been proposed to inject refuse with coal into a Detroit stoker. A Detroit stoker comprises a moving grate which is not supplied with coal by means of a hopper and weir but which has a layer of coal blown onto it from suitable injectors in the back wall. A proposal has been made that refuse should be mixed with the coal being blown into the Detroit stoker. Unfortunately, however, with such an arrangement it has been found that the refuse tends to form discrete islands in the coal mass and these islands burn out rapidly and permit air to pass easily through the moving bed of material on the grate. As a result of this, it has been found that there is an incomplete combustion of the coal and the local high velocity air streams moving through the bed of material on the grate causes an excess of dust to be formed which passes through the combustion chamber and can overload the dust-arresting equipment.

The conditions above a continuous bed of material such as is provided by the present invention are much less fierce. For example, paper ash can be seen to float smoothly within the combustion chamber above the moving bed of coal and the ash is not blasted out through into the precipitation equipment.

Prior art conventional refuse incinerators frequently had a bed of refuse of about 3 to 8 ft in thickness and this refuse was incompletely combusted in practice. The total thickness of refuse on the bed of coal in accordance with the invention would not normally exceed 12 inches.

The amount of heat given off by a given weight of refuse amounts to some 50% of the equivalent weight of industrial coal. The thermal output of the boiler can comprise up to 75% of heat from the refuse. The heat generated is used to evaporate water to produce steam in the normal manner. Ash formed from the refuse moves along the grate 3 and is dealt with in the same manner as the coal ash produced by the furnace.

It will be readily appreciated that the installation utilises most, if not all, of the existing coal-fired moving grate furnace equipment and therefore the capital expenditure required to install the refuse burner is very low. It will also be realised that the refuse becomes a valuable source of fuel and the prime object is to obtain a cheap fuel source, not merely to obtain a reduction in the volume of refuse dealt with.

By blowing the refuse into the combustion chamber, a maximum surface area of refuse is intimately mixed with adequate combustion air so increasing the rate of combustion of the refuse.

Figure 2:
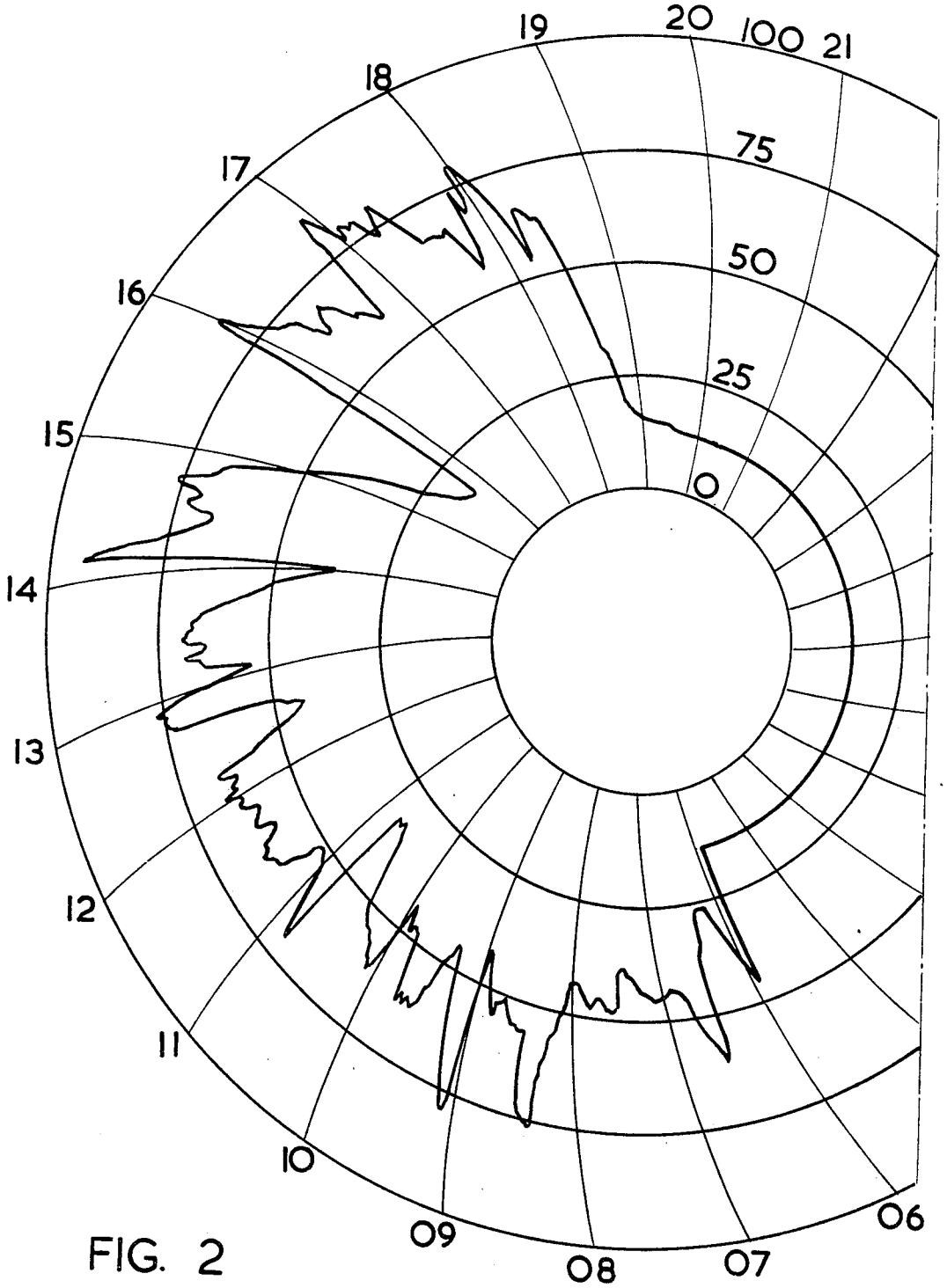
FIG. 2 is a graph of steam output against time.

Referring to FIG. 2, this shows the relationship between steam output and time for a boiler which has been modified to burn refuse in accordance with the invention. The steam output is in thickness of pounds per hour. It can be seen that during the night period from approximately 7pm until 6am, the boiler output is just over 15,000 pounds of steam per hour. During the day, the output is approximately 50,000–75,000 pounds of steam per hour.

During the tests, 5 ton loads of refuse were injected, the first one being injected at 10.45, the second at 12.30, the third at 14.00, the fourth at 15.45, and the last one at 16.45. It can be seen that there was an immediate response with the steam output rising from about 32,000 pounds at 10.45 to a peak of 70,000 pounds and levelling out between 60,000 and 65,000 pounds. This pattern was repeated each time and the immediate response available from the refuse can be seen clearly from FIG. 2.

If required, the refuse could be fired continuously, thus removing the troughs between the peaks on the curve. It will be seen that the base load between the troughs on the curve is supplied by the heat output from the coal bed alone.

Further tests have shown that the 75,000 pounds per hour output can be maintained quite easily with adequate supply of refuse. It can be seen, therefore, that the output of the boiler was $\frac{1}{3}$ from the coal bed and $\frac{2}{3}$ from the refuse. This is vastly in excess of anything which has been possible with prior art boiler assemblies.

If the refuse were to be mixed with the coal, it would adversely affect the distribution of air through the grate and would lead to disturbed and incomplete burning conditions which would reduce the thermal efficiency to an unacceptable degree. Because there is very little room between the upper surface of the coal layer 6 and the face 16, it is not possible to apply a layer of refuse on top of the coal layer 6. Furthermore, if the furnace were modified to permit this, it would not be possible to obtain such a high surface area for combustion of the refuse when compared with the injection system of the invention.

It has been found that the best results are obtained if the bed of coal is thoroughly alight and burning before it passes out from underneath the arch defined by the face 16. If the bed is thoroughly alight and burning, the injected refuse has been found to be distributed uniformly over the burning bed. If, however, the bed is only partially alight, the refuse has been found to pile up in heaps and is not thoroughly distributed. It is not known why this happens, but it may be that a thoroughly burning bed causes extra local currents of air immediately above the bed and these currents of air distribute the refuse uniformly.

I claim:

1. A method of burning refuse including the steps of establishing a substantially uniform bed of burning coal on a moving grate floor, the bed of burning coal being located at the lower end of a combustion chamber, and entraining refuse in particulate form in a gas jet directed into the combustion chamber through the back wall of the combustion chamber in the opposite direction to the direction of movement of the grate, the velocity of the gas jet being such that the heavier particles are projected towards the front of the bed of coal, to fall onto the moving bed of coal and to be burned with the coal, while the lighter particles of the refuse are burned in suspension above the moving bed of coal.

2. A method as claimed in claim 1 in which the bed of coal is thoroughly alight and burning before the bed is moved into an area in which the refuse can land on the bed.

3. A method as claimed in claim 2 in which the refuse is burned in a furnace having an arch over the inlet end of the grate, and in which the coal is thoroughly alight and burning before leaving the arch.

4. A method as claimed in claim 1 in which the gas jet is directed parallel to the grate.

5. A method as claimed in claim 1 in which there is a secondary classifying air jet directed up at the moving stream of refuse inside the combustion chamber.

6. A method as claimed in claim 5 in which the classifying gas jet is provided at substantially the same pressure as the air jet which entrains the refuse.

7. A method as claimed in claim 1 in which the grate is a moving chain grate.

8. A method as claimed in claim 1 in which there is an air feed through the moving grate floor.

9. A method as claimed in claim 1 in which the refuse has a particle size distribution such that 80% of the refuse has an average diameter of less than 5 cm, and is treated to remove the magnetic particles.

10. A method as claimed in claim 1 in which there is a 50% excess of air supplied to the combustion chamber compared to that theoretically required to fully oxidise the coal and refuse.

11. A method as claimed in claim 1 in which refuse supplies in the region of 25% to 75% of the total heat input to the combustion chamber.

12. A method as claimed in claim 5 in which the gas jet which entrains the refuse is air and provides 5 to 15% of the total air volume supplied to the combustion chamber and in which the secondary classifying air jet also supplies 5 to 15% of the total air volume supplied to the combustion chamber.

13. A method as in claim 1 wherein the gas jet is an air jet.

14. A method of burning refuse which comprises establishing a substantially uniform bed of burning coal on a grate floor which moves generally horizontally in the lower end of a combustion chamber in a direction away from a front wall of the chamber toward a back wall of the chamber, passing air upwardly through the grate, injecting the refuse in particulate form entrained in a stream of air into the combustion chamber at a location near the back wall of the chamber and above the bed in a direction opposite to the direction of movement of the grate, directing a classifying air stream up at the entrained refuse as it passes over the bed, the air streams acting together to project heavier particles of refuse above the bed and so as to fall onto the bed near the front wall of the combustion chamber and to suspend lighter particles of refuse in the combustion chamber above the bed so that they burn in suspension.

* * * * *